US010119665B2

(12) United States Patent
Lin

(10) Patent No.: US 10,119,665 B2
(45) Date of Patent: Nov. 6, 2018

(54) VARIABLE HANGING LIGHTING

(71) Applicant: Ling Yung Lin, Taipei (TW)

(72) Inventor: Ling Yung Lin, Taipei (TW)

( * ) Notice: Subject to any disclaimer, the term of this patent is extended or adjusted under 35 U.S.C. 154(b) by 43 days.

(21) Appl. No.: 15/388,709

(22) Filed: Dec. 22, 2016

(65) Prior Publication Data

US 2018/0180229 A1 Jun. 28, 2018

(51) Int. Cl.

| | |
|---|---|
| ***F21S 4/22*** | (2016.01) |
| ***F21V 21/008*** | (2006.01) |
| ***F21V 23/06*** | (2006.01) |
| ***F21V 17/18*** | (2006.01) |
| ***F21V 23/00*** | (2015.01) |
| ***F21V 3/02*** | (2006.01) |
| *F21Y 103/10* | (2016.01) |
| *F21Y 115/10* | (2016.01) |
| *F21W 121/04* | (2006.01) |

(52) U.S. Cl.

CPC ..... *F21S 4/22* (2016.01); *F21V 3/02* (2013.01); *F21V 17/18* (2013.01); *F21V 21/008* (2013.01); *F21V 23/001* (2013.01); *F21V 23/06* (2013.01); *F21W 2121/04* (2013.01); *F21Y 2103/10* (2016.08); *F21Y 2115/10* (2016.08)

(58) Field of Classification Search

CPC ..... A47G 33/06; A47G 33/0836; A47G 33/0863; A47G 33/10; A47G 33/1246; A47G 33/1266; A47G 2033/0827; F21S 4/20–4/26; F21V 21/008

See application file for complete search history.

(56) References Cited

U.S. PATENT DOCUMENTS

| | | | | |
|---|---|---|---|---|
| 6,379,021 | B1 * | 4/2002 | Shieh | A47G 33/06 362/123 |
| 2009/0154156 | A1 * | 6/2009 | Lo | F21V 5/00 362/234 |
| 2010/0008090 | A1 * | 1/2010 | Li | F21V 17/007 362/249.03 |
| 2015/0062890 | A1 * | 3/2015 | Camarota | F21V 5/04 362/223 |
| 2017/0122507 | A1 * | 5/2017 | Hoffman | F21S 4/22 |

* cited by examiner

*Primary Examiner* — Anh Mai
*Assistant Examiner* — Steven Horikoshi
(74) *Attorney, Agent, or Firm* — Rabin & Berdo, P.C.

(57) ABSTRACT

A variable hanging lighting, which is mountable on a carrier to form a designed lighting fixture having a three-dimensional shape, includes a flexible light strip, a flexible long channel member and multiple slings. The light strip has multiple luminous bodies arranged in a linear array to form a luminous surface on the light strip that outwardly emits light. The long channel member includes a bottom with multiple locating holes, two side walls, and two convexly fixed flanges that form a notch that accommodates the light strip. The slings each have at least one engaging element connected to a respective locating hole via an engaging connector to hang the long on a carrier so that the bottom of the long channel member is close to the carrier, and the luminous surface emits light in a direction away from the carrier.

16 Claims, 8 Drawing Sheets

VARIABLE HANGING LIGHTING

BACKGROUND OF THE INVENTION

1. Field of the Invention

The invention relates to a decorative lighting ,and more particularly, to a variable hanging lighting applied flexible light strips and light grooves for free forming, assembly convenience, good lighting effect.

2. Description of Related Art

Fantastic lighting performance is always attractive. People like and enjoy the atmosphere been created particular for holiday celebration, birthday, wedding, weekend party and festival. In Christmas, light strings are generally used for decorating the Christmas Tree and make it into typical Christmas symbol, which are placed on predetermined trees and frames for simulating gorgeous and shiny visual effect of Christmas trees.

However, a conventional light string is normally produced on connecting sequence of mini light bulbs with cables for a serial structure light string. The light string is generally presenting bulb on cable with no directional and the cable does not a durable production for long term using, thus it is often inconvenient and restricted, and service life of the conventional light string is limited. Furthermore, in the past, the light string is mostly placed by using ropes or bands to fix cables on several predetermined positions, so that the lights on the cables may be separated naturally, but position and irradiation direction of each light cannot be firmly fixed, so that the position of lights are significantly different and the direction of lights are different, even reversed. When the lights are opened, light sources would not be regular and the brightness is different, so that expected lighting effect could not be reached.

Therefore, in view of the above drawbacks of conventional light strings in structure and application, the inventor researched for improvement upon years experience on touching related industries, and the present invention is finally created.

SUMMARY

The object of the present invention is to provide a variable hanging lighting, especially that the light strip and a long channel member defining a groove therein (the channel member being, hereinafter referred to as "groove") are easily to engage and bend, the light strip could be firmly fix on the carrier to arrange the predetermined lighting design easily, and the slings are provided to hang by a back side of the long groove, so that the luminous surface of the light strip is provided to form stable and good lighting effect in the direction away from the carrier.

Moreover, in the present invention, SMD (surface-mount devices) technology is used to form a light strip by continuously and extendedly arranging the luminous bodies linear array thereof, and the luminous bodies are sealed with an insulated colloid, so that when the light strip is used to arrange to shape, the distance between luminous bodies and the direction of the luminous bodies may not be significantly different, and insulation material provided to cover on the light strip could not only ensure the safety of use, but also enhance durability of the light strip.

The variable hanging lighting of the present invention is mainly provided to set on a carrier to form a designed lighting with a three-dimensional shape according to demands In order to achieve the above object, the main technical means includes a flexible light strip, a flexible long groove and multiple slings; wherein, the light strip having multiple luminous bodies linear array thereof, and the luminous bodies form a luminous surface on the light strip to emit light outwards; the flexible long groove includes a bottom with multiple locating holes thereof and two side walls respectively connected to two sides of the bottom, a notch is formed between the two side walls away from the bottom, two fixed flanges are respectively and convexly set inwards on the two side walls along the notch, so that the light strip is provided to embedded into the long groove and fixed by the two fixed flanges to let the luminous surface of the light strip face the location of the notch; at least an engaging element provided to connect to the locating hole is set on each sling, thereby, the bottom of the long groove is close to the carrier when the long groove is hanged on the carrier three-dimensionally, so that the luminous surface of the light strip placed in the long groove is provided to emit light in the direction away from the carrier.

Preferably, wherein the light strip includes a strip type of an electric conductor and a translucent insulator covered on the electric conductor, the luminous bodies are set on the electric conductor.

Preferably, wherein the luminous bodies are SMD LEDs.

Preferably, wherein the light strip further includes a connector set on its one end for connecting to an external lighting, and the connector is electrically connected to the electric conductor.

Preferably, wherein each engaging element having an engaging connector is provided to pass through the locating hole and fixedly engage with it.

Preferably, wherein the engaging connector is a buckle, a hook or a latch.

Preferably, wherein the carrier is a support frame of a geometric shape.

Preferably, the carrier includes at least a support frame, a base is set on a bottom of the support frame, and the long groove is provided to set around the support frame.

Preferably, wherein the slings are ropes, threads or chains.

In the present invention, the flexible long groove with a concave positioning is made by technology of plate punching and curling, a continuous inward curved fixed flange set on the notch is provided to form a block to set the light strip in the groove, multiple locating holes on the bottom are engaged with the engaging element by buckling or hooking, and the function of easy assembly and free shaping disclosed in the present invention may be achieved with the slings, such as ropes, threads or chains.

A metal plate is mainly used as a base material of the above long groove that a predetermined shape may be made by metal processing, and the function of shaping and hanging disclosed by the present invention may be achieved with the engaging element and the slings.

Besides, except metal processing, the long groove may also be made by plastic injection molding or extrusion processing, the function of shaping and hanging disclosed by the present invention may also be achieved.

In order to provide a further understanding of the present invention to those skilled in the art, the following preferred embodiment of the present invention would be described in details with drawings to illustrate the technical means and the achieved effects of the present invention.

DETAILED DESCRIPTION OF THE INVENTION

Please refer to FIG. 1 and FIG. 2, the present invention mainly includes a light strip 20, a long channel member 30 defining therein a groove (the channel member being hereinafter referred to as "groove") and multiple slings 40, wherein, the light strip 20 and the long groove 30 are flexible strip-shaped bodies and they could be engaged with each other easily. By using the slings 40 to hang the long groove 30 in its back side, the long groove 30 and the light strip 20 set inside it may be placed in the predetermined position, irradiation direction of the light strip may be well controlled, and a free shaping and quickly assembling hanging lighting could be provided.

Figure 3:
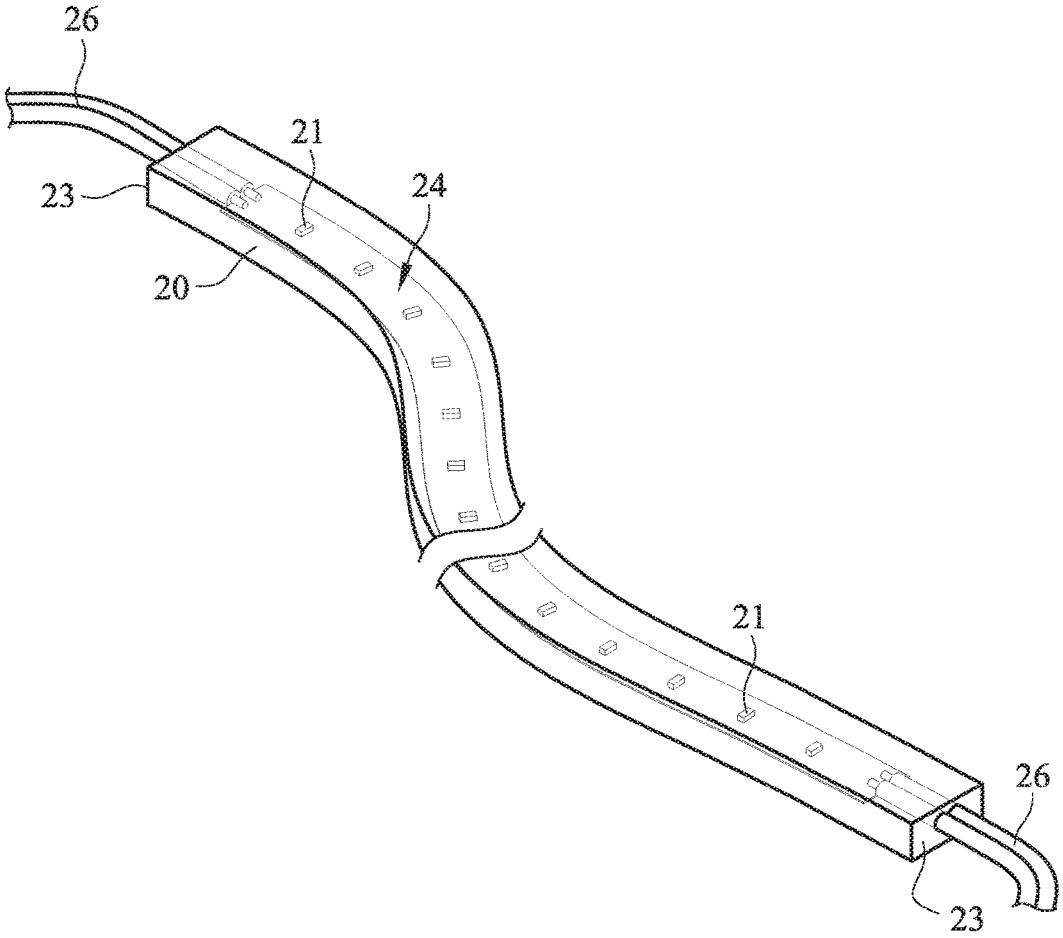
FIG. 3 is a structure schematic diagram of the light strip of the preferred embodiment of the present invention.

The light strip 20, please refer to FIG. 3 simultaneously, mainly includes a strip type of an electric conductor 22 with multiple luminous bodies 21 set on its surface and a translucent insulator 23 covered outside, the strip-shaped light strip 20 is formed. The side of the electric conductor 22 that the luminous bodies 21 arranged on is the luminous surface 24 of the light strip 20, the luminous bodies 21 are provided to emit light outwards from the luminous surface 24 through the translucent insulator 23.

In the embodiment, the light strip 20 is mainly a tube light strip made of SMD LED, the electric conductor 22 is a strip-shaped and flexible metal sheet, LED patches are provided as the luminous bodies 21 welded on the electric conductor 22 with outside sealing of the insulator 23 made of insulating colloid to seal the electric conductor 22 and the luminous bodies 21 to form the light strip 20 with a predetermined shape. The light strip 20 and the long groove 30 could be a corresponding circular, triangular, square or polygonal shape with each other, the surface of the light strip 20 made of colloid could be a smooth or tactile surface for firmly fixing on the long groove 30 or forming a special lighting effect.

Figure 4:
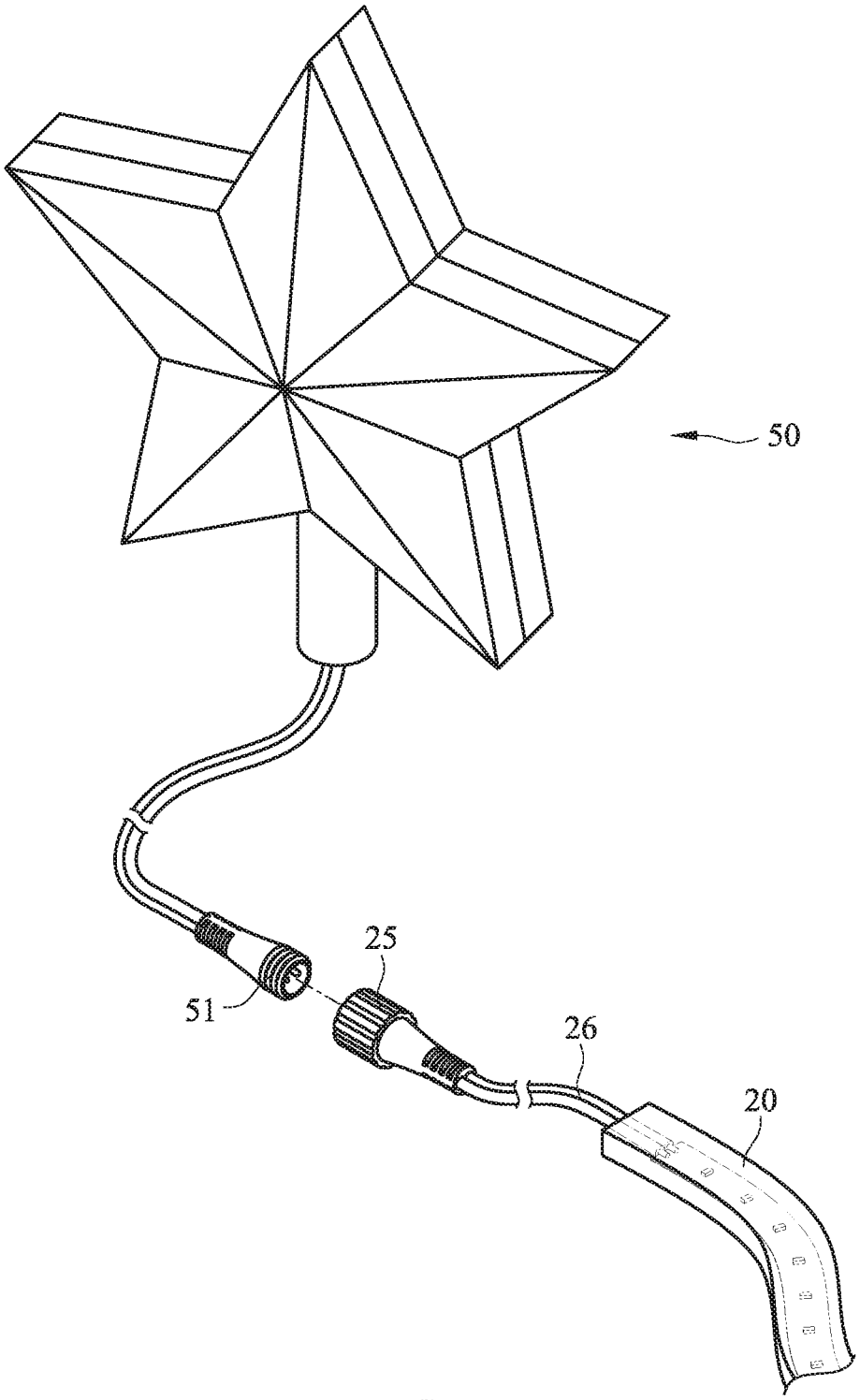
FIG. 4 is a schematic diagram of the external lighting of the light strip of the preferred embodiment of the present invention.

A cable 26 extended outwards is set on at least one end of the light strip 20, the cable 26 electrically connected to the electric conductor 22 is provided to connect to a power supply for supplying power to the light strip 20. In an implemented embodiment, as shown in FIG. 3 and FIG. 4, two cables 26 extended outwards are set on both two ends of the light strip 20, the cable 26 set on its one end is provided to connect to power supply, and a connector 25 could be set on the cable 26 set on another end for connecting to other light strip or the connector 51 of the lighting 50, so that the light strip 20 could be extended by serious connecting for satisfying applications with different requirements, to thereby generate various lighting styles.

Figure 1:
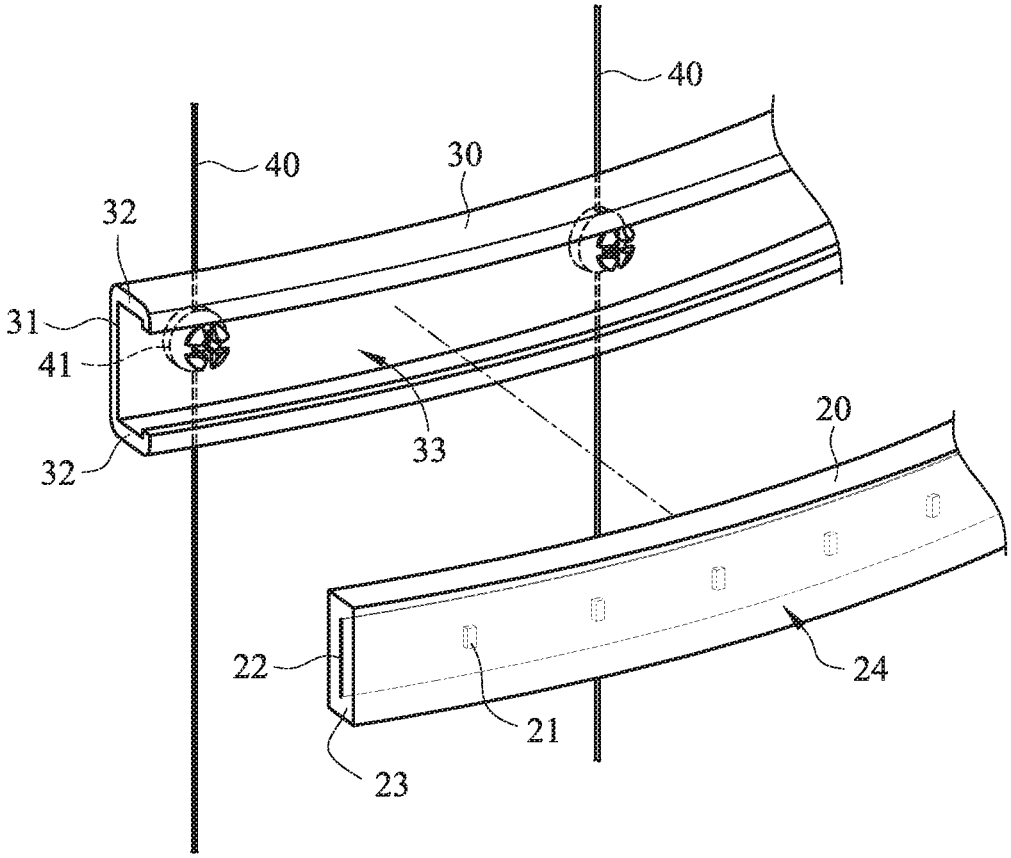
FIG. 1 is an exploded diagram of the preferred embodiment of the present invention.
Figure 2:
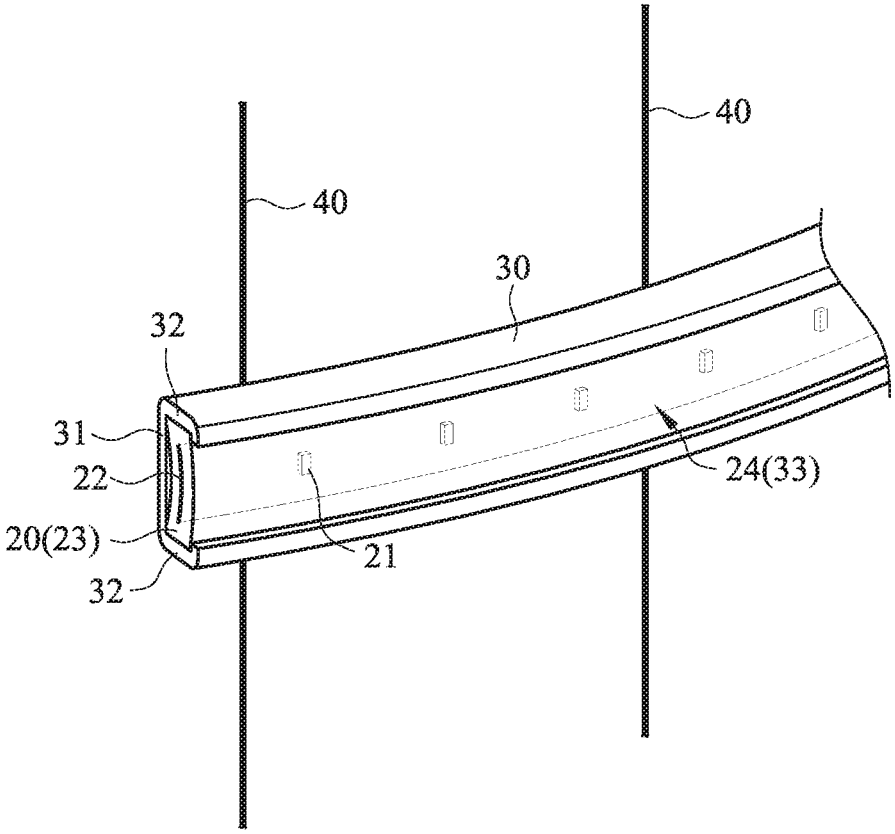
FIG. 2 is an assembly diagram of the preferred embodiment of the present invention.
Figure 5A:
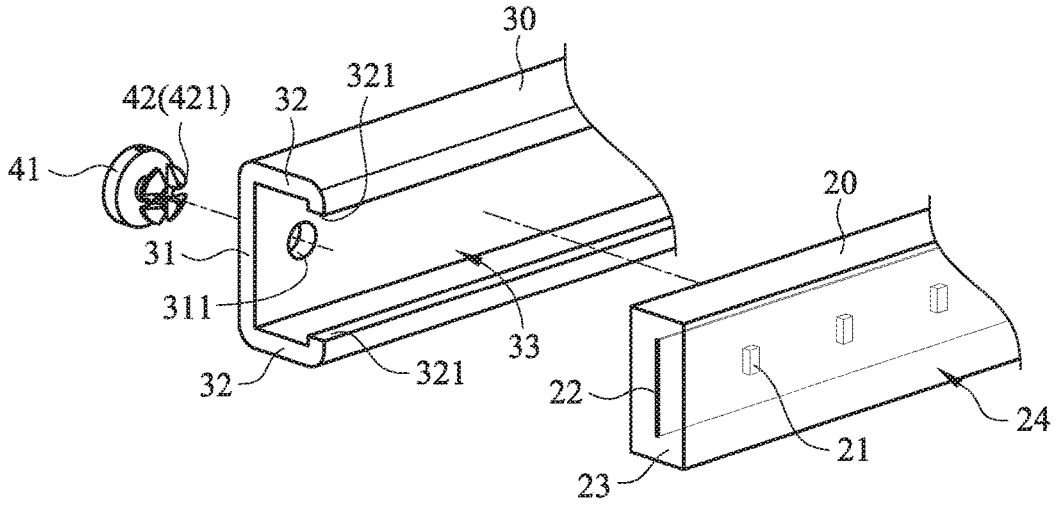
FIGS. 5*a* and 5*b* are respectively a structure schematic diagram and a sectional schematic diagram of combination of a preferred embodiment of the present invention.
Figure 5B:
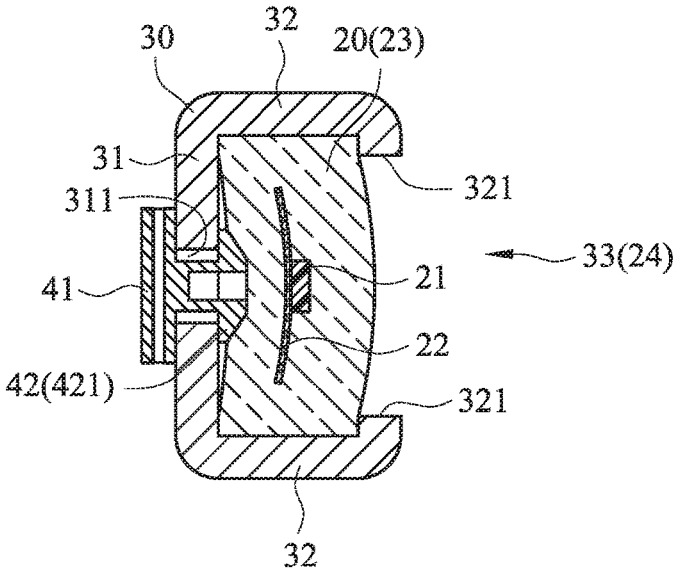

The long groove 30 and the slings 40, please refer to FIG. 1, FIG. 5*a* and FIG. 5*b*; the groove shape of the long groove 30 could be matched with the shape of the light strip 20, and its basic structure at least includes a bottom 31 and two side walls 32, multiple locating holes 311 are set on the bottom 31, the two side walls 32 are respectively connected to two sides of the bottom 31, a notch 33 is formed on the two side walls 32 away from the bottom 31, two fixed flanges 321 are respectively and convexly set inwards on the two side walls 32 along the notch 33, so that the light strip 20 is provided to embedded into the long groove 30 and fixed by the two fixed flanges 321 to let the luminous surface 24 of the light strip 20 face the location of the notch 33; at least an engaging element 41 provided to connect to the locating hole 311 is set on each sling 40, an engaging connector 42 set on each engaging element 41 is provided to pass through the locating hole 311 and fixedly engage with it, the engaging element 41 could be engaged to position on a back side of the long groove 30, so that the long groove 30 could be hung on a predetermined position of the carrier, and the bottom 31 of the long groove 30 is touched the carrier while hanging, so that the notch 33 faces outwards, thus the luminous surface 24 of the light strip 20 placed in the long groove 30 is provided to emit light in the direction away from the carrier, and a designed lighting could be formed with a three-dimensional shape and good lighting effect.

In the embodiment, the long groove 30 is a linear groove body and be processed from basic materials, such as metal material, plastic material, or composite materials of metal and plastic, the bottom 31 and the notch 33 are respectively formed by two opposite sides of the long groove, the bottom 21 is provided to engage with the slings 40 for position, the notch is provided to fix the irradiation direction of the light strip 20, so that the designed lighting with a three-dimensional shape according to the present invention could have better lighting effect.

Figure 5C:
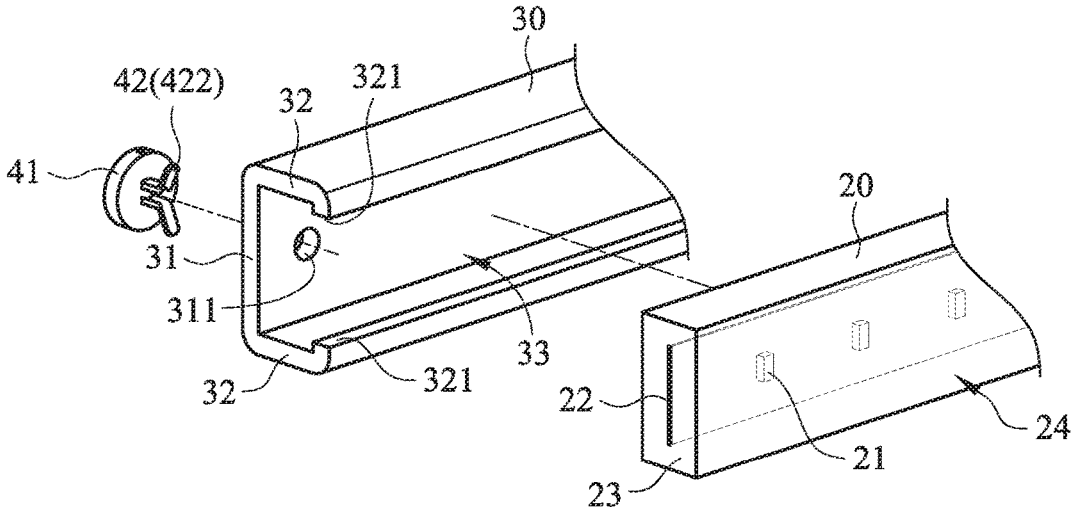
FIGS. 5*c* and 5*d* are respectively a structure schematic diagram and a sectional schematic diagram of combination of a preferred embodiment of the present invention.
Figure 5D:
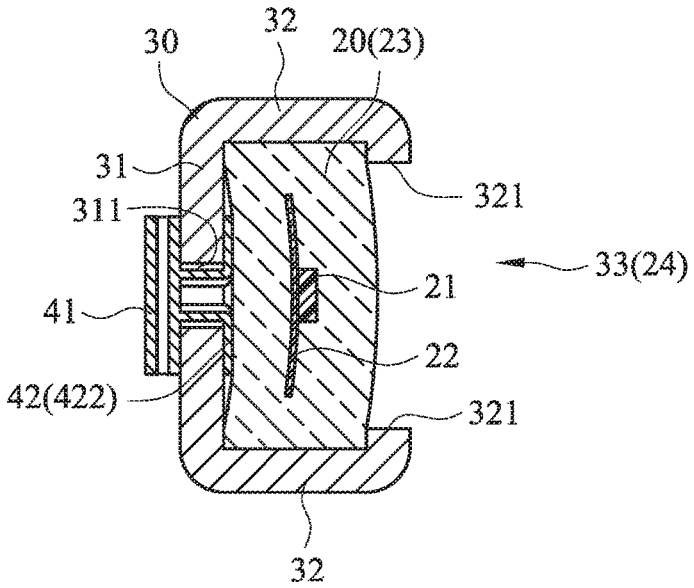
Figure 5E:
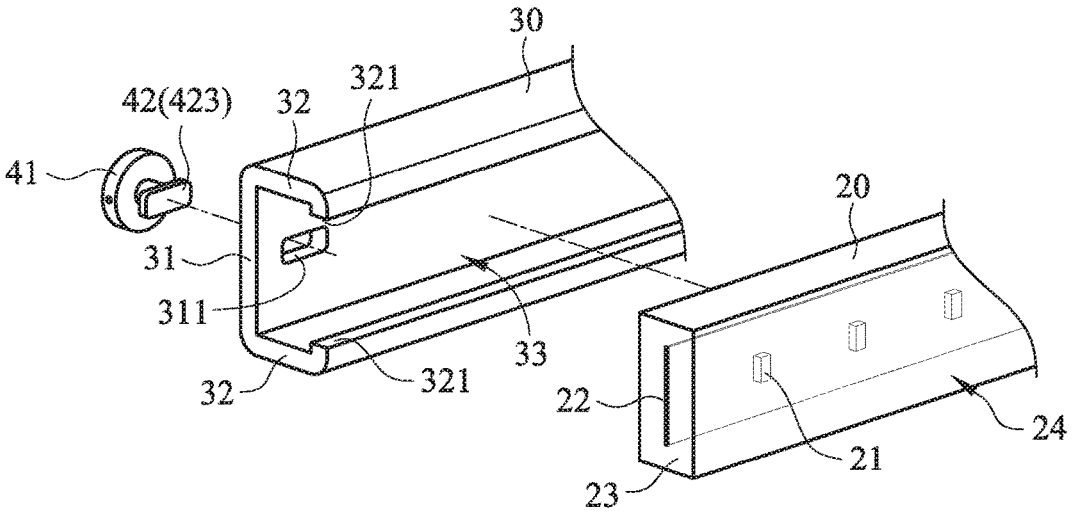
FIGS. 5*e* and 5*f* are respectively a structure schematic diagram and a sectional schematic diagram of combination of a preferred embodiment of the present invention.
Figure 5F:
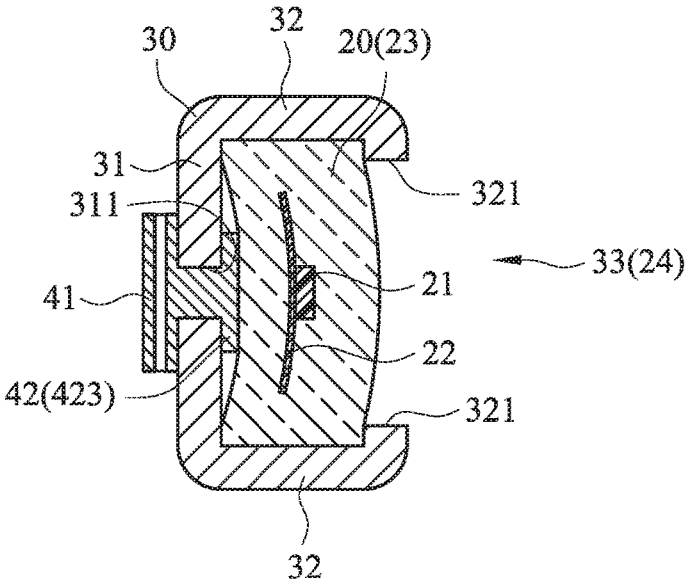

There are many possible ways for implementing the engaging connectors 42 of the engaging element 41, as shown in FIG. 5*a* and FIG. 5*b*, the engaging connector 42 could be a buckle 421 for buckling into the locating hole 311, it could be buckled into the locating hole 311 by pressing, it could be assembled quickly and the positioning is formed fixedly without caring the combination order of each element while assembling; as shown in FIG. 5*c* and FIG. 5*d*, the engaging connector 42 is a hook 422 for inserting into the locating hole 311, the positioning is formed by engaging the hook 422 with the light strip 20; as shown in FIG. 5*e* and FIG. 5*f*, the engaging connector 42 is a latch 423 having a corresponding shape with the shape of the locating hole 311, in the embodiment, both the locating hole 311 and the engaging connector 42 are strip type, the engaging connector 42 could be inserted into the locating hole with an appropriate rotating angle, and it could be positioned if being rotated to other angle.

Figure 6:
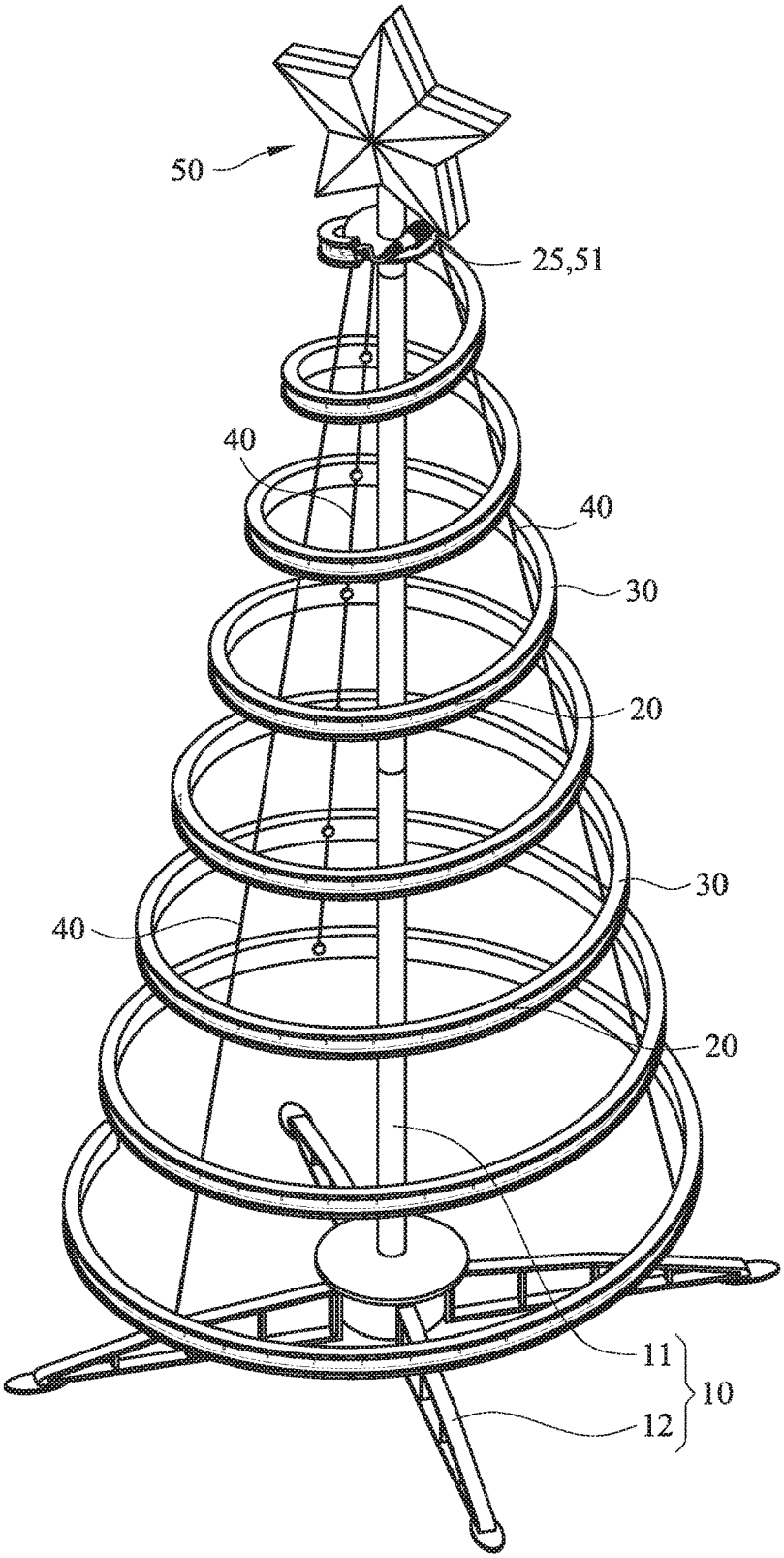
FIG. 6 is an implementation diagram of the preferred embodiment of the present invention.

In implementation, the embodiment is provided to set on a carrier 10, the carrier 10 could be an entity or a frame of any geometric shape, as shown in FIG. 6, the carrier 10 is an upright support frame, which mainly includes a support frame 11 and a base 12, the long groove 30 could be hung around the carrier 10 by using the slings 40 to form a designed lighting with a three-dimensional shape. As shown in the embodiment, there are many engaging elements 41 set on the slings 40, so that the long groove 30 could be spirally hung on the carrier 10, and the luminous surface 24 of the light strip 20 is provided to emit light in the direction away from the carrier 10 according to the direction of the notch 33, to achieve stable and balanced lighting effect.

Above all, the present invention could certainly improve many drawbacks of conventional light strings in positioning, irradiation direction, durability, and it could be widely applied, so it would meet requirements for patent applications and the inventor applied according to law. The embodiments disclosed in the present invention are only used to give examples of the present invention and illustrate technical features of the present invention, not used to limit the scope of the present invention, the specific scope of the present invention should be the claimed scope of application, any change or equitable arrangement that may be easily made by one skilled in the art is within the scope of the present invention.

What is claimed is:

1. A variable hanging lighting, which is mountable on a carrier to form a designed lighting fixture having a three-dimensional shape, comprising:

a flexible light strip having multiple luminous bodies arranged in a linear array to form a luminous surface on the flexible light strip to outwardly emit light;

a flexible long channel member that is configured to accommodate the flexible light strip, that includes a bottom in which are defined multiple locating holes and having two sides, that has two side walls respectively connected to the two sides of the bottom to define a notch between the two side walls away from the bottom, and that has two fixed flanges that are respectively and convexly set inwards on the two side walls along the notch, so that the flexible light strip is accommodated within the notch of the flexible long channel member and fixed by the two fixed flanges to let the luminous surface of the light strip face outwardly from the notch; and multiple slings for hanging the flexible long channel member on the carrier, each sling of the multiple slings having at least one engaging element provided to connect to a respective locating hole of the multiple locating holes to place the bottom of the flexible long channel member in close proximity to the carrier when the flexible long channel member is mounted on the carrier three-dimensionally, each engaging element of the at least one engaging elements having an engaging connector that passes through the locating hole and that fixedly engages the locating hole so that the luminous surface of the flexible light strip placed in the flexible long channel member is oriented to outwardly emit light away from the carrier.

2. The variable hanging lighting as claimed in claim 1, wherein the flexible light strip includes an electric conductor that is a conductive strip; and a translucent insulator cover provided on the electric conductor, wherein the multiple luminous bodies are disposed on the electric conductor.

3. The variable hanging lighting as claimed in claim 2, wherein the multiple luminous bodies are SMD LEDs.

4. The variable hanging lighting as claimed in claim 3, wherein the flexible light strip further includes a connector that is disposed on one end thereof, that is configured to connect to an external lighting, and that is electrically connected to the electric conductor.

5. The variable hanging lighting as claimed in claim 4, wherein the engaging connector is a buckle, a hook or a latch.

6. The variable hanging lighting as claimed in claim 4, wherein the carrier is a support frame having a geometric shape.

7. The variable hanging lighting as claimed in claim 4, wherein the carrier includes at least a support frame, a base disposed on a bottom of the support frame, and the flexible long channel member is disposed around the support frame.

8. The variable hanging lighting as claimed in claim 4, wherein the slings are ropes, threads or chains.

9. The variable hanging lighting as claimed in claim 2, wherein the engaging connector is a buckle, a hook or a latch.

10. The variable hanging lighting as claimed in claim 2, wherein the carrier is a support frame having a geometric shape.

11. The variable hanging lighting as claimed in claim 2, wherein the carrier includes at least a support frame, a base disposed on a bottom of the support frame, and the flexible long channel member is disposed around the support frame.

12. The variable hanging lighting as claimed in claim 2, wherein the slings are ropes, threads or chains.

13. The variable hanging lighting as claimed in claim 1, wherein the engaging connector is a buckle, a hook or a latch.

14. The variable hanging lighting as claimed in claim 1, wherein the carrier is a support frame having a geometric shape.

15. The variable hanging lighting as claimed in claim 1, wherein the carrier includes at least a support frame, a base disposed on a bottom of the support frame, and the flexible long channel member is disposed around the support frame.

16. The variable hanging lighting as claimed in claim 1, wherein the slings are ropes, threads or chains.

* * * * *